US007344021B2

(12) United States Patent
Muraro

(10) Patent No.: US 7,344,021 B2
(45) Date of Patent: Mar. 18, 2008

(54) PACKAGE BLOCK OF ENVELOPES

(75) Inventor: Pierre Muraro, Davezieux Cedex (FR)

(73) Assignee: Garnier Ponsonnet Vuillard (FR)

( * ) Notice: Subject to any disclaimer, the term of this patent is extended or adjusted under 35 U.S.C. 154(b) by 395 days.

(21) Appl. No.: 10/966,965

(22) Filed: Oct. 14, 2004

(65) Prior Publication Data

US 2006/0081485 A1 Apr. 20, 2006

(51) Int. Cl.
*A65C 11/34* (2006.01)

(52) U.S. Cl. ..... 206/214; 206/386; 206/451; 206/449

(58) Field of Classification Search ..... 206/214, 206/386, 425, 449, 451, 591, 593, 814, 821; 229/68.1, 72, 82
See application file for complete search history.

(56) References Cited

U.S. PATENT DOCUMENTS 1,719,617 A 7/1929 Novick
3,415,663 A * 12/1968 Raschke et al. ..... 426/129
3,986,611 A 10/1976 Dreher
4,817,260 A 4/1989 Martin
5,370,233 A * 12/1994 Schutz et al. ..... 206/597
5,372,255 A * 12/1994 Skorski et al. ..... 206/386
6,138,900 A * 10/2000 Zeiler ..... 229/67.4
2006/0157367 A1 * 7/2006 Carrigan et al. ..... 206/425

FOREIGN PATENT DOCUMENTS

EP 0 591 099 A1 4/1994
EP 0 602 327 A1 6/1994
EP 1 352 845 A1 10/2003

* cited by examiner

*Primary Examiner*—David T. Fidei
(74) *Attorney, Agent, or Firm*—Bachman & LaPointe

(57) ABSTRACT

A packaged block of envelopes comprises a series of envelopes, retaining plates disposed on either side of said series of envelopes, and a peripheral holding binder. In the vicinities of each of two of its corners, each of the envelopes has at least one thickness compensation wedge having a thickness substantially equal to the thickness of its closure flap, so that the envelopes are of total thickness that is identical at all four of their corners.

20 Claims, 5 Drawing Sheets

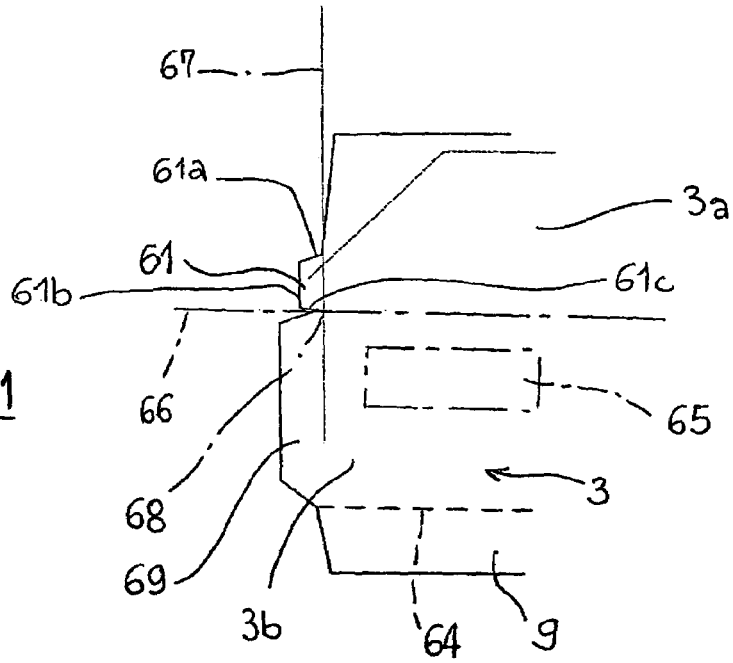
FIG. 11
FIG. 12
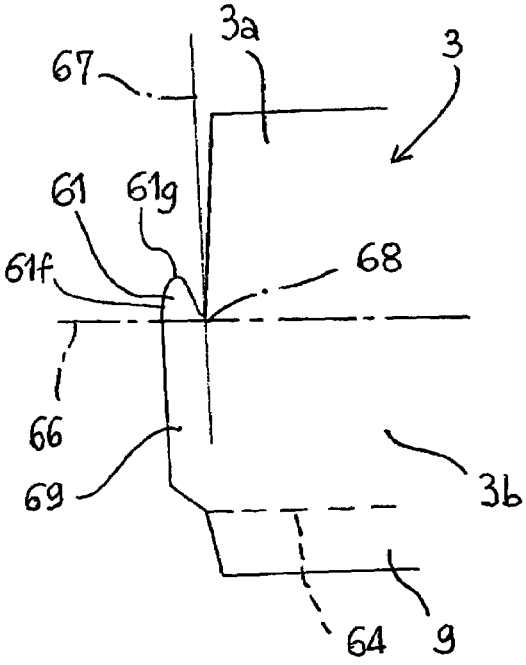
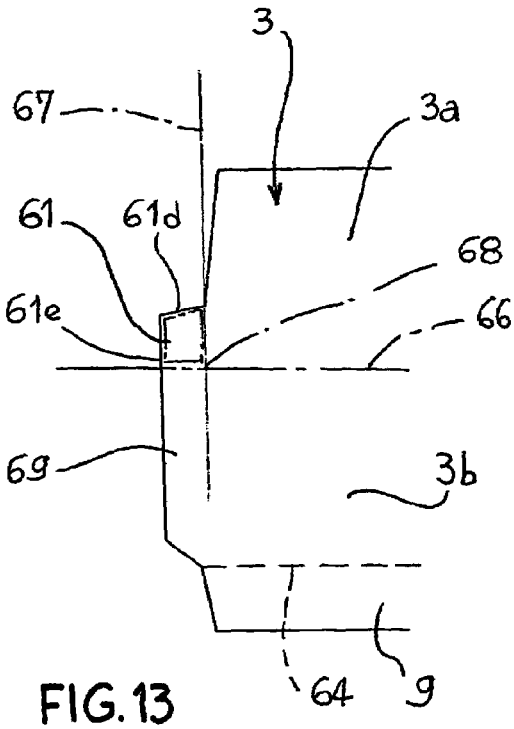
FIG. 13

PACKAGE BLOCK OF ENVELOPES

BACKGROUND OF THE INVENTION

1. Field of the Invention

The invention relates to packaging and unpackaging envelopes.

In the present text, the term "envelopes" is used to mean any paper or even cardboard bags designed to receive letters, sheets of paper, or any other article that might be contained therein. In general, an envelope is considered to be a "flat item", a term that is in frequent use. This applies herein, the envelope having a certain amount of flexibility, depending on how it is structured, such flexibility giving rise, in particular under stress, to deformation due to differences in thickness that exist at different places of each envelope.

2. Description of the Prior Art

FR-A-2 837 793 discloses a packaged block of envelopes that offers improved stability and/or improved surface evenness compared with solutions prior to that solution. For that purpose, that packaged block of envelopes comprises:

- a series of folded envelopes, each of which has a front face onto which a closure flap for closing the envelope is folded over, a back face, and a periphery, the envelopes being disposed face against face, each face of each envelope having first, second, third, and fourth corners, and the closure flap having a thickness and being suitable for being folded over along an edge of the folded envelope that interconnects the first and second corners;
- rigid retaining plates disposed on either side of said series of envelopes, one plate facing one of the faces, namely the front face or the back face, of the first envelope in the series, and the other plate facing the other face of the last envelope in the series; and
- holding means for holding the series of envelopes together, said holding means surrounding the series of envelopes and the two retaining plates tightly.

Those retaining plates are preferably uninterrupted, plane, and smooth, each plate being provided with two vertical side grooves that are open to receive spacer rods, making it possible to remove the blocks of envelops without breaking (or indeed removing) the holding means which are advantageously elastically deformable and which surround the series of envelopes and the retaining plates in an elastic state.

FR-A-2 837 793 also discloses a set comprising:

- a series of packaged blocks of envelopes as presented above;
- a goods-handling pallet on which a plurality of blocks of envelopes stand, at least some of the blocks being disposed so that each of the envelopes stands on a segment of its periphery, and on which rigid retaining plates stand for retaining said blocks facing a top bearing surface of the pallet; and
- wrapping means for wrapping the pallet and the series of envelopes disposed on it, those wrapping means comprising an elastic stretch film stretched in its elastic deformation zone.

SUMMARY OF THE INVENTION

The invention provides:

- a packaged block of envelopes offering further-improved stability and/or further-improved surface evenness;

- a set of such packaged blocks of envelopes on a goods-handling pallet facilitating handling, stability and/or packaging in blocks so that subsequent unpackaging is easier;
- a method of further improving packaging and/or unpackaging the blocks of envelopes.

As regards the first aspect (packaged block of envelopes), the invention provides an improved solution to the observed problems of surface unevenness.

An important characteristic of the invention recommends using a packaged block of envelopes in which, in the vicinity of each of the third and fourth corners, each of the envelopes has at least one thickness compensation wedge or wedge having a thickness substantially equal to the thickness of the closure flap so that the envelope has a total thickness that is substantially identical in all of said first, second, third, and fourth corners.

According to another characteristic, it is recommended that, with each envelope preferably being obtained by folding, and when the envelope is in a fully unfolded state, each of the thickness compensation wedges has an outline that is curved, or made up of a plurality of sides, advantageously with obtuse angles.

For the choice of the binder surrounding the block of envelopes, a stretch film of plastic is preferred to a non-elastic hoop band, in particular for absorbing, over time, any reduction in the volume of the series of envelopes.

Also as regards the thickness compensation wedges, each of the thickness compensation shims is advantageously situated along two crossing fold lines that intersect each other at the boundary of said wedge, when the envelope is in a fully unfolded state, thereby making the wedges easier to implement and to position.

It is also recommended:

- for at least one of the retaining plates to have corners and perforations situated spaced apart from said corners, so that the thickness compensation wedges of the envelopes come into abutment against plane surface portions of the retaining plates; and/or
- for each of the rigid retaining plates to have an essentially smooth first face against which said series of envelopes bears and a second face having pieces of roughness against at least some of which said holding means bear.

Preferably, said pieces of roughness are ribs making it easier to take hold of the rigid retaining plates for the purpose of separating said retaining plates and said holding means from the series of envelopes, when unpackaging the block of envelopes, without breaking said holding means that remain around the retaining plates during the unpackaging. Providing perforations in the retaining plates also makes it easier to take hold of them for unpackaging purposes.

Making provision for the rigid retaining plates to have peripheral edges and perforations that are at least locally defined by one type of line selected from curved lines and lines that slope relative to at least one of said peripheral edges of the retaining plate makes it possible to prevent the flaps or the windows of the corresponding envelopes from snagging during packaging or unpackaging.

Another aspect of the invention relates to a manner of making it easier to handle a series of packaged blocks of envelopes on a pallet.

Therefore, a characteristic of the invention makes provision to use a goods-handling pallet on which said packaged blocks of envelopes are disposed, the envelopes standing via edges of their peripheries on the goods-handling pallet, the blocks being disposed in a plurality of rows of stacks, adjacent rows of stacks of packaged blocks of envelopes being separated by a rigid vertical spacer extending perpendicular to those edges of the peripheries of the envelopes on which said envelopes stand.

Advantageously:

the rows of blocks of envelopes extend in the height direction over at least four superposed layers of blocks of envelopes in at least two adjacent rows of stacks; and the rigid spacer between two such rows of stacks extends over a height at least equal to the height of said four layers.

Another inventive aspect that can be independent of the above thus relates to a method of unpackaging a said block of envelopes.

A problem that this method solves is the problem of opening the tightly-wrapping holding means, while avoiding damaging the envelopes or moving them out of position, e.g. by offsetting them.

One solution proposed by the invention consists in taking hold of the retaining plate firmly, while pushing on the sheets so as to separate them from the retaining plates and from the holding film by using the pieces of roughness and/or the perforations of the plates for this purpose.

The use of an elastic stretch film or binder is then particularly advantageous.

An even more detailed description of the invention is given below with reference to the accompanying drawings which are given merely as examples, and in which:

BRIEF DESCRIPTION OF THE DRAWINGS

FIGS. 11, 12, and 13 locally show the outlines of envelope sheets as unfolded.

DETAILED DESCRIPTION OF THE PREFERRED EMBODIMENT(S)

Figure 1:
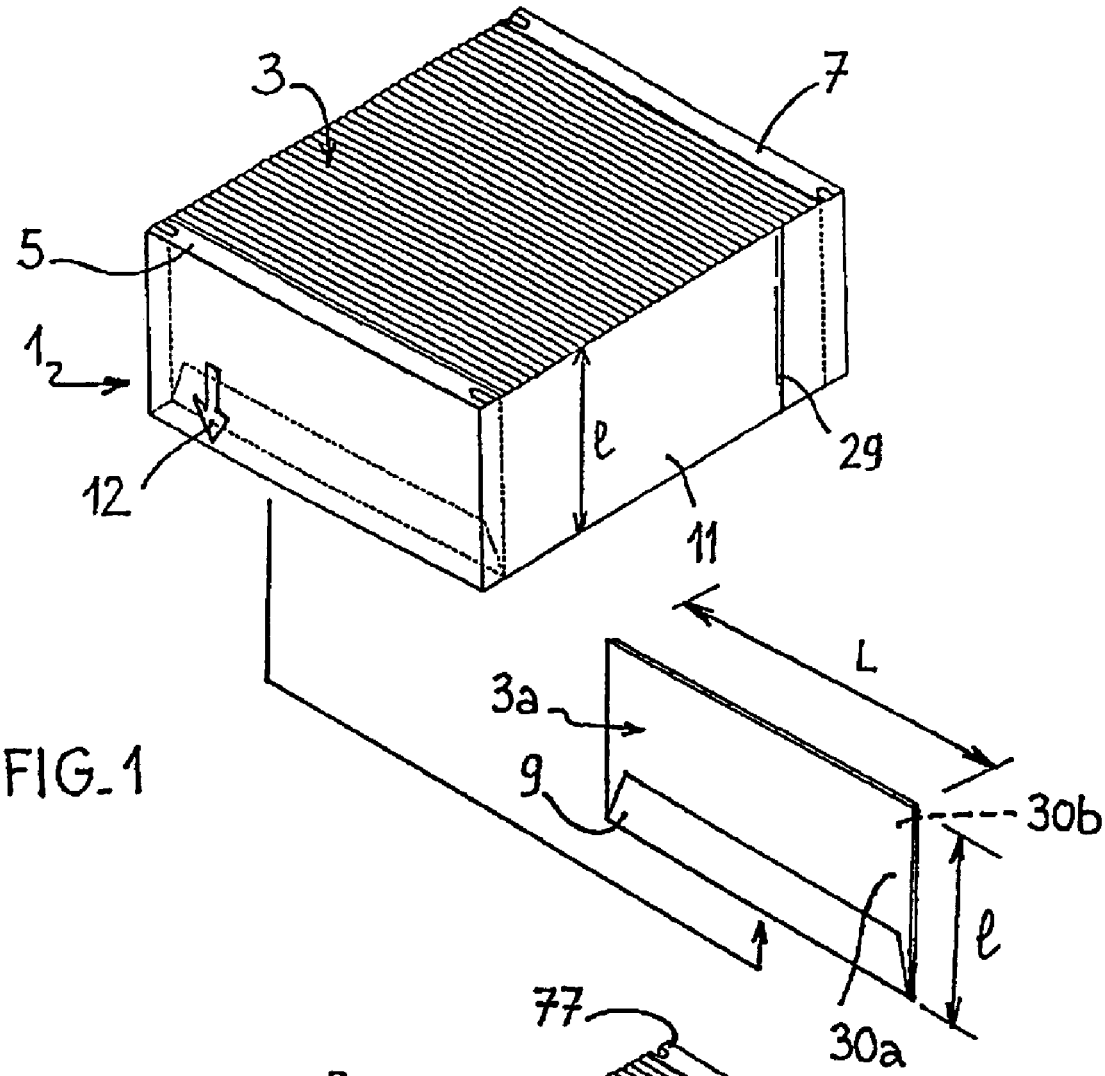
FIGS. 1 and 2 show two solutions of the invention for packaging a batch of envelopes.

FIG. 1 shows a packaged block 1 of envelopes. This block or set is made up of a succession of envelopes 3, and of rigid retaining plates 5, 7 between which the batch of envelopes 3 is disposed and held.

Like the envelope 3*a* that has been extracted from the batch, all of the envelopes in this series are identically disposed and oriented. Thus, for the intermediate envelopes, like envelope 3, they are in face-against-face contact, each with the two envelopes adjacent to it respectively via its front face 30*a*, and via its back face 30*b*.

The retaining plates for retaining the series of envelopes are advantageously constituted by two rigid plates that are perforated and ribbed, and that are rectangular, e.g. substantially plane plates made of plastic and having the same dimensions as the envelopes which, in this example, are all of the same dimensions and are disposed with their closure flaps 90 identically situated on all of the envelopes of the batch. The flap 9 is folded over onto a portion of the front face 30*a* but it is not closed (i.e. it is not stuck to the body of the envelope).

For the retaining plates, it is also possible to consider using plates that are naturally curved, and that reach a plane state under stress from the wrapping means.

Tightly-wrapping holding means 11 for holding the envelopes of the batch tightly together are disposed around the envelopes of the batch and around the retaining plates 5, 7.

Said tightly-wrapping holding means are constituted by a band that surrounds the envelopes and the plates tightly, which band is, in this example, a stretch film made of a plastics material, such as a film of polyethylene which, once it is placed tightly around the batch of envelopes and around the plates 5, 7 is still in an elastically deformable state.

The envelopes are rectangular. Each of them has a fine periphery 13 with, along said fine periphery, two opposite edges of short length l and two opposite edges of long length L. The same applies to the plates 5, 7.

The tightly-wrapping holding means 11 extend over two opposite edges of short length l of each of the envelopes and of the retaining pates, and they advantageously extend over the entire short length l of the envelopes and of the plates.

Figure 2:
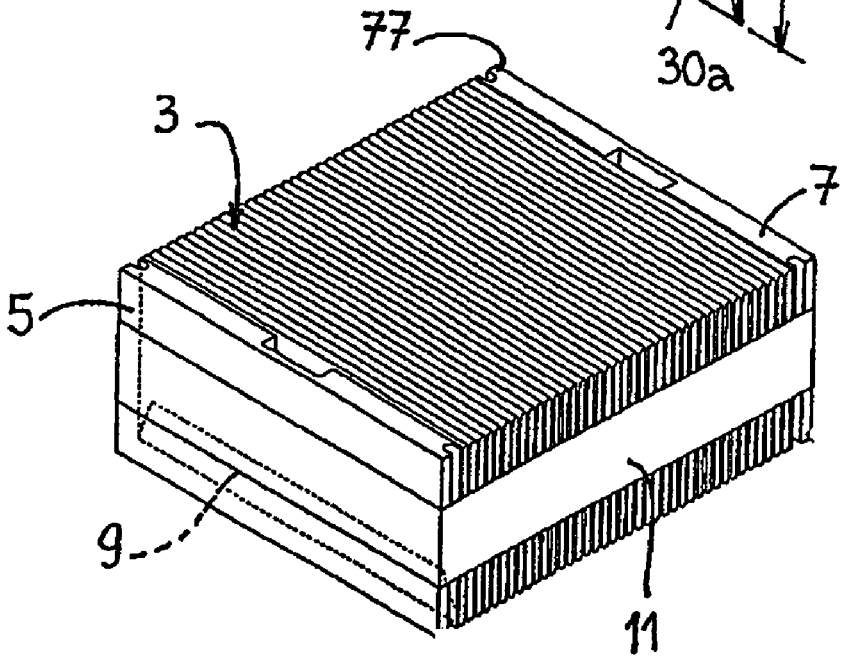

In FIG. 1, indicator means 12 indicate that the closure flap faces the plate 5 along its bottom long length (like the situation of the flap 9 that can be seen through the plate in FIG. 2).

A stretch wrapping machine makes it possible to place the stretch film of plastic 11 around the batch of envelopes 3 and around the end retaining plates 5, 7.

The indicator 29 shown in FIG. 1 marks the bonding zone of the stretch film in which said film is bonded to itself after it has been put under tension and separated from the roll on the stretch wrapping machine.

Figure 3:
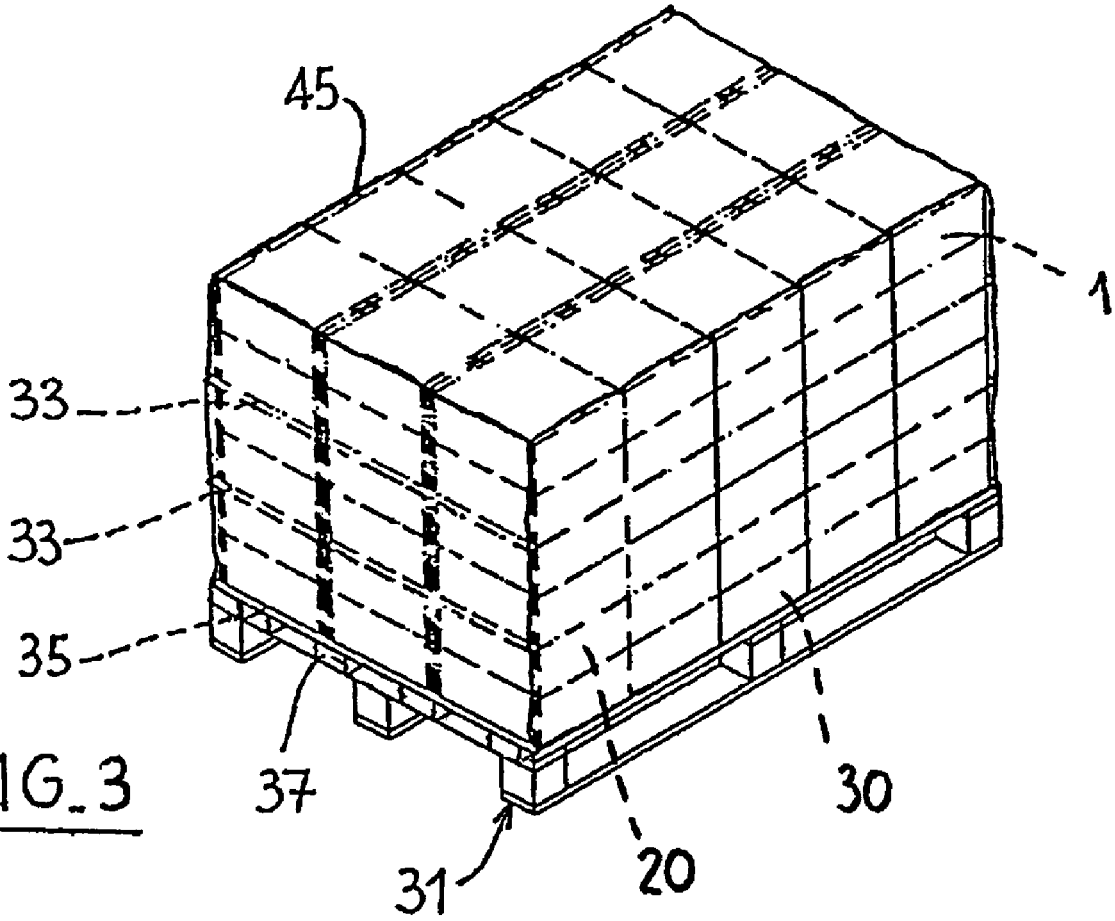
FIG. 3 shows a goods-handling pallet loaded with a series of packaged blocks of envelopes.

FIG. 3 shows a set of packaged blocks of envelopes such as 1, 20, 30, disposed in adjacent stacks on a goods-handling pallet 31.

The various blocks such as 20, 30 are identical to the block 1 of FIG. 1 and they are disposed via long edges of the peripheries of the envelopes either on an identical lower block or directly on the top surface 32 of the pallet.

Spacer sheets such as 33 can be interposed between the layers.

In FIG. 3, the entire set of stacks of packaged envelopes are shown wrapped in a stretch wrapper film 45.

The preceding figures do not show the preferred embodiment of the retaining plates 5, 7.

Figure 4:
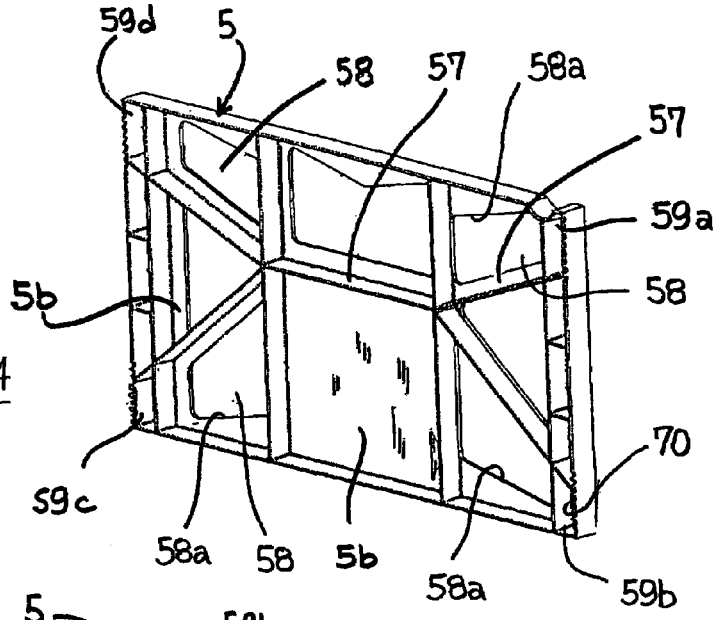
FIG. 4 shows the outside face of a preferred embodiment of a retaining plate for retaining the envelopes, FIG. 5 locally showing the inside face for bearing against the envelopes.
Figure 5:
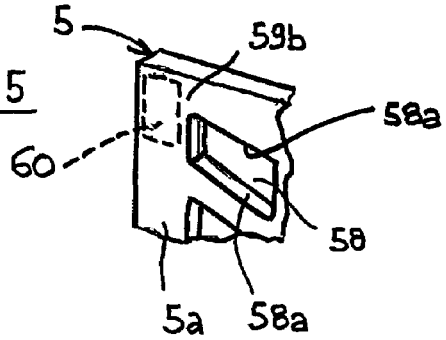

This embodiment is shown in FIGS. 4, 5 in particular, in which only one of the two plates (referenced 5) is shown. The other plate used is advantageously identical, and both plates are designed to be disposed in the same manner as shown in FIGS. 1 and 2 in order to form the desired block.

Figure 7:
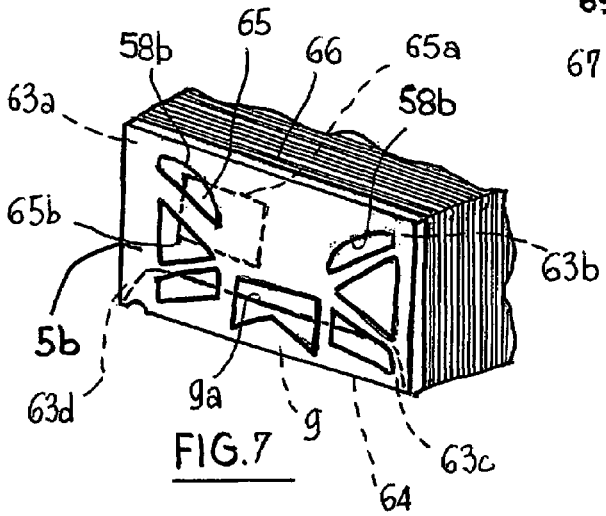
FIG. 7 shows envelopes and an alternative embodiment of a retaining plate.

Thus, the preferred embodiment of each retaining plate 5, 7 is a plate that is ribbed or perforated on an outside face referenced 5B in FIG. 4. Conversely, the inside face 5*a* is advantageously plane and smooth, in order to avoid thickness errors on the made-up blocks. Said inside face receives the envelopes 3 which bear against it. Optionally, the outside face 5*b* can be smooth, as shown in FIG. 7, but it is preferably ribbed and perforated as shown in FIG. 4.

The ribbing and/or the perforating of the outside face 5*b* facilitates taking hold of the retaining plates 5, 7 in order to separate the plates and the binder 11 surrounding them from the series of envelopes 3 when unpackaging a block of envelopes, without it then being necessary to break said binder which thus remains around the plates during said unpacking.

Figure 8:
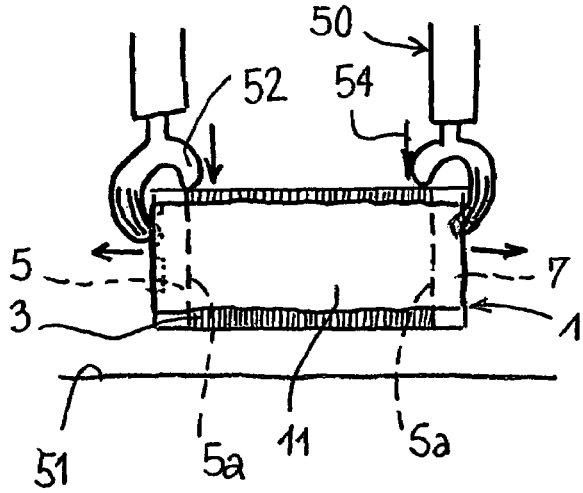
FIGS. 8 and 9 show two successive unpackaging steps.
Figure 9:
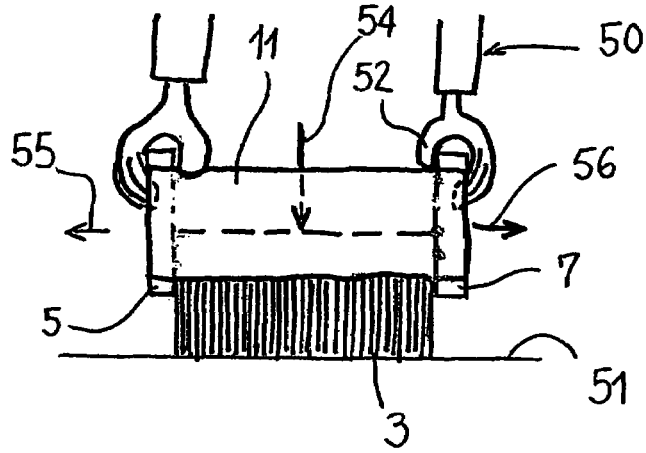

In FIGS. 8 and 9, it can be seen that, in order to perform the unpacking, the operator 50 firstly holds the packaged block 1 above a bearing surface 51.

On the inside, the operator places the thumbs 52 above the series of envelopes 3, at the top edges of the plates 5, 7, while, on the outside, the other fingers 53 hold the plates firmly by pushing on the corresponding zones of the film 11 and by gripping (or at least pressing against) the outside ribbing on said plates 5, 7 and/or the above-mentioned perforations.

Under vertical thrust from the thumbs 52, the series of envelopes 3 descends by gravity (FIG. 9) as soon as the operator 50 not only presses vertically in the direction indicated by the arrow 54 but also pushes the plates 5, 7 apart laterally in the directions indicated by the arrows 55 and 56 (this being facilitated in particular by the recommended elasticity of the film 11).

It is thus possible to unpackage the series of envelopes 3 without having to break the film 11, the advantageously plane and smooth nature of the inside surfaces (such as 5*a*) of the retaining plates facilitating sliding without the closure flaps or the window zones of the envelopes being snagged as they go past, as explained below.

In FIG. 4, the retaining plate 5, 7 is provided with ribs 57 extending in different directions.

In addition to the ribs, the retaining plate 5 shown is thus provided with perforations 58 passing through the plate between its two faces (FIGS. 4, 5, and 7).

Since the retaining plates 5, 7 are preferably rectangular block shaped, the plate shown is rectangular with four corners 59*a*, 59*b*, 59*c*, and 59*c* (FIG. 4).

The perforations 58 are disposed spaced apart from said corners, as can be seen in particular at the corner 59*b* shown in FIG. 5 on the plane and smooth inside face 5*a*.

Disposing the perforations 58 some distance away from the corners facilitates the general balance of the packaged block, by making it possible to manage taking up thickness. This is particularly important when several hundreds of envelopes are packaged together. Four zones are thus obtained that have plane and smooth surfaces, i.e. surfaces without any roughness that might degrade taking up thickness. And it is facing each of these zones 60 that a respective one (referenced 61 in FIG. 6) of two thickness compensation wedges on each envelope 3 comes into position, once the packaging is complete.

FIGS. 6 and 11 to 13 make it possible to understand clearly why thickness wedges such as 61 are necessary and how they are implemented.

Figure 6:
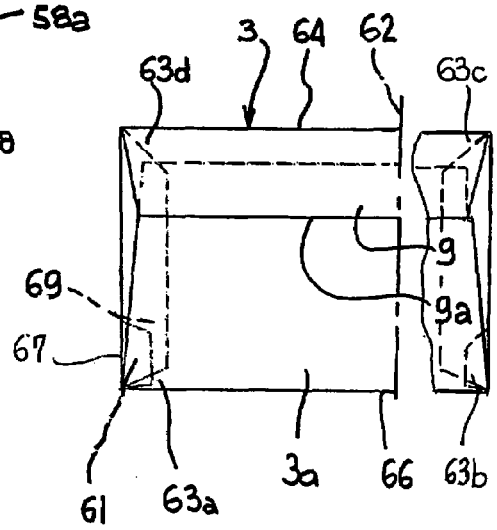
FIG. 6 shows one half of an envelope.

It should be noted firstly that each envelope is provided with such thickness wedges, the second wedge being obtained symmetrically about the axis 62 of FIG. 6.

Thus, the two thickness wedges 61 are situated at the two corners 63*a* and 63*b* in FIG. 7 of each envelope that are opposite from the other two corners 63*bc* and 63*d* between which the closure flap 9 is folded over.

The outside edge (longitudinal in this example) along which said flap 9 is folded over is referenced 64.

The line forming said edge 64 is shown in dashed lines in FIGS. 11 to 13 in which it can be seen that each envelope 3 is obtained by folding a base sheet whose outline has been cut to the desired shape.

The outlines of the three embodiments shown differ only at the thickness compensation wedges 61 (shown in dot-dash lines in FIG. 13).

Each of the FIGS. 11, 12, and 13 thus shows the longitudinal fold edge 64, the back face 3*b* in which the transparent window 65 (FIG. 11) can be provided, and, adjacently, the front face 3*a* onto which the closure flap 9 folds over after the sheet has also been folded along the line 66 which extends parallel to the line 64, which constitutes the boundary between the front and back faces, and which also defines the second longitudinal edge of the envelope (see FIG. 6), the two corners 63*a*, 63*b* being situated at either end of said edge 66.

The fold line 66 and a second fold line 67 which is perpendicular thereto define the two lines that, in each of the FIGS. 11, 12, and 13, intersect each other at 68, at the boundary of the thickness compensation wedge 61 shown, naturally in the state shown in which an envelope is entirely unfolded (the situation at the other wedge being to be imagined once again by symmetry about the axis 62).

In FIG. 11, the thickness compensation wedge 61 has sides 61*a*, 61*b*, and 61*c* that define obtuse angles between them in pairs.

In FIG. 6, the thickness compensation wedge is shown on the envelope as folded, after said envelope has been folded over along the two lines 66 and 67, so that said wedge occupies a zone in the corner 63*a* facing the folded-over side tab 69, said thickness compensation wedge 61 being interposed between this inward folded-over tab 69 and the surface of paper 3*a* which defines the front face, so that, in the corners 63*a*, 63*b* four thicknesses of paper are to be found including the zones 3*a*, 3*b*, 61 and 69.

Towards the opposite corner 63*d* (or 63*c*), four thicknesses of paper are also to be found that are constituted by the flap 9, the folded-over side tab 69, and the zones of paper defining the front and back faces 3*a* and 3*b*.

By means of the two corner wedges 61, a thickness is thus obtained that is identical in all four corners of the envelope, and by applying the four corners against four corner zones (identical to zone 60 in FIG. 5) of the retaining plates 5, 7, it is possible to ensure that good stability is obtained for the packaged block of envelopes, without any warping.

In FIG. 13, the thickness compensation wedge 61 is defined, on the outline of the sheet of paper shown, merely by two sides 61*d*, 61*e* forming an obtuse angle between them: as in FIG. 11, these two sides are rectilinear.

In FIG. 12, the outline of the sheet locally (at 61*f*) follows a curved line marking the thickness compensation shim. This curved outline extends to a rounded crest 61*g* in a direction parallel to the line 67 and thus substantially perpendicular to the edge 64 of the envelope.

Thus, in the solutions shown in FIGS. 6 and 11 to 13, the thickness compensation wedges such as 61 are integrated parts of the envelope, by being defined by a portion of the sheet making up the envelope.

Optionally, it is alternatively possible to add a patch by adhesive bonding. However, that solution is not recommended because it is costly and less reliable.

FIGS. 4 and 5 show that the perforations 58 are defined, except for their vertical edges, by sloping lines 58*a* that slope relative to the peripheral edges of the rectangular block defined by the plate 5 shown.

Between adjacent perforations, said perforations define bars that are presented above as being ribs 57.

In the absence of such ribs, said bars could be flush with the plane of the general outside surface 5*b* of the plate, as shown in FIG. 7 in which said outside face 5*b* is exempt from said ribs even though it is provided with the perforations 58 with sloping lines 58*a*, or even curved lines 58*b*.

Once the envelopes 3 are in place, as shown in FIG. 7, the first envelope of the series presses against the plane and smooth inside face of each plate, and it then appears that the sloping lines 58*a* also slope relative to the edges 64, 66 of the envelope, relative to the free longitudinal edge 9*a* of the flap 9, and relative to the two longitudinal edges (also parallel) 65*a*, 65*b* of the window 65 of said envelope.

Thus, these edges do not snag on going past the boundaries of the perforations.

The boundaries of said perforations can thus be rectilinear and sloping or curved (line 58*b* in FIG. 7).

Optionally, for taking hold of the plates 5, 7, all or some of the ribs, where such ribs exist, can be replaced or supplemented by pieces of roughness on which at least one finger of the operator could grip for unpackaging purposes (except for the thumb, in view of what is said above with reference to FIGS. 8 and 9).

FIG. 4 shows teeth 70 that catch on the film 11 to prevent it from slipping over the outside face 5*b*, in particular during said unpackaging.

Figure 10:
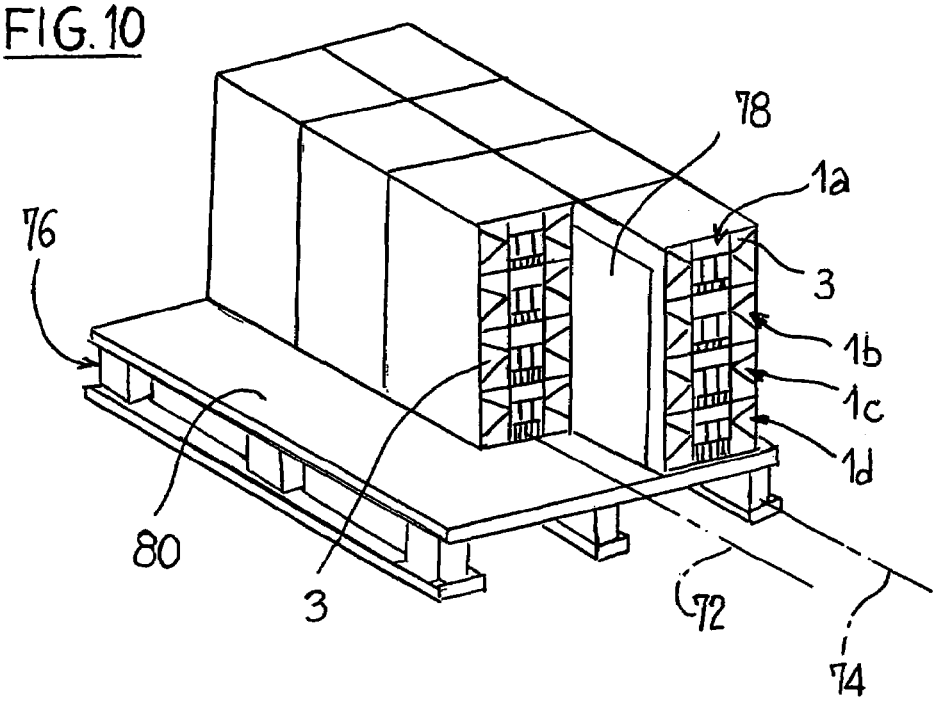
FIG. 10 shows a pallet loaded with packaged blocks of envelopes.

FIG. 10 shows two rows 72 and 74 of stacks of packaged blocks of envelopes 3 on a pallet 76 identical to the pallet 31.

A plurality of blocks of envelopes 3 stood on the peripheries of the envelopes rest on the pallet 76, in this example in the two rows of stacks 72, 74 separated by the rigid separator 78.

Said separator extends perpendicularly to those edges of the peripheries of the envelopes via which said envelopes stand and it is thus vertical in this example. It stands on edge on the top deck 80 of the pallet, and can be as long as the pallet.

The spacer 78 is preferably a plate made of cardboard, of plastic, or of a material based on cellulose. Cardboard is preferred.

As shown, the series of envelopes 3 extend in the height direction over at least four superposed layers of blocks referenced 1*a*, 1*b*, 1*c*, and 1*d*, in respective ones of the adjacent rows of stacks.

The rigid spacer 78 extends upwards over a height at least equal to said four layers.

What is claimed is:

1. A packaged block of envelopes comprising:

a series of folded envelopes, each said folded envelope having a front face onto which a closure flap is folded over, a back face, and a periphery, the envelopes being disposed face against face, each face of each envelope having first, second, third, and fourth corners, and each said closure flap having a thickness and being suitable for being folded over along an edge that interconnects the first and second corners;

rigid retaining plates disposed on either side of said series of envelopes, said rigid retaining plates including a first plate facing a first one of the front and back faces of a first envelope in the series, and a second plate facing a second one of the front and the back faces of a last envelope in the series; and holding means for holding the series of envelopes together, said holding means surrounding the series of envelopes and the retaining plates tightly;

in which packaged block of envelopes, in the vicinity of each of the third and fourth corners, each of the folded envelopes has at least one thickness compensation shim having a thickness substantially equal to the thickness of the closure flap so that the folded envelope has a total thickness that is substantially identical in all of said first, second, third, and fourth corners.

2. A packaged block of envelopes according to claim 1, in which:

each of the envelopes is made up individually from at least one folded-over sheet; and the thickness compensation shims situated in the vicinities of the third and fourth corners of the envelopes are defined by a portion of said sheet used to make up each envelope and they are thus integral parts of said envelopes.

3. A packaged block of envelopes according to claim 2, in which:

each envelope is in a folded state obtained by folding said at least one sheet used for making said envelope; and when the envelope is in a fully unfolded state, each of the thickness compensation shims has an outline made up of a plurality of sides.

4. A packaged block of envelopes according to claim 3, in which two adjacent sides of the outline of each of the thickness compensation shims define an obtuse angle between them.

5. A packaged block of envelopes according to claim 2, in which:

each envelope is in a folded state obtained by folding said at least one sheet used for making said envelope; and when the envelope is in a fully unfolded state, each of the thickness compensation shims has a curved outline.

6. A packaged block of envelopes according to claim 5, in which the curved outline extends to a rounded crest in a direction substantially perpendicular to that edge of the envelope along which the closure flap is folded over when the envelope is in the folded state.

7. A packaged block of envelopes according to claim 1 or claim 2, in which each of the thickness compensation shims is situated along two crossing fold lines that intersect each other at the boundary of said shim, when the envelope is in a fully unfolded state.

8. A packaged block of envelopes according to claim 1, in which at least one of the retaining plates is perforated and has bars between adjacent perforations, at least some of the bars sloping relative to said edge of each envelope along which the closure flap is folded over.

9. A packaged block of envelopes according to claim 1, in which at least one of the retaining plates has corners and perforations situated spaced apart from said corners, so that the at least one thickness compensation shim of each said envelope comes into abutment against plane surface portions of the retaining plates.

10. A block of envelopes according to claim 1, in which each of the rigid retaining plates has an essentially smooth first face against which said series of envelopes bears and a second face having pieces of roughness against at least some of which said holding means bear.

11. A block of envelopes according to claim 10, in which the pieces of roughness are ribs making it easier to take hold of the rigid retaining plates for the purpose of separating said retaining plates and said holding means from the series of envelopes, when unpackaging the block of envelopes, without breaking said holding means that remain around the retaining plates during the unpackaging.

12. A packaged block of envelopes comprising:

a series of folded envelopes, each said folded envelope having a front face onto which a closure flap is folded over, a back face, and a periphery, the envelopes being disposed face against face;

rigid retaining plates disposed on either side of said series of envelopes, said rigid retaining plates including a first plate facing a first one of the front and back faces of a first envelope in the series, and a second plate facing a second one of the front and back faces of a last envelope in the series, each of the rigid retaining plates having a first face with an essentially plane and smooth surface against which said series of envelopes bears; and holding means for holding the series of envelopes together, said holding means surrounding the series of envelopes and the retaining plates tightly;

in which packaged block of envelopes, each of the rigid retaining plates has a second face opposite from the first face and having at least one means selected from the group consisting of perforations and pieces of roughness making it easier to take hold of the rigid retaining plates for separating said retaining plates and said holding means from the series of envelopes, when unpackaging the block of envelopes, without breaking said holding means that remain around the retaining plates during the unpackaging.

13. A block of envelopes according to claim 12, in which the holding means are constituted by a stretch film of plastic.

14. A block of envelopes according to claim 12, in which the rigid retaining plates have peripheral edges and perforations that are at least locally defined by one type of line selected from curved lines and lines that slope relative to at least one of said peripheral edges of the retaining plate.

15. A block of envelopes according to claim 12, in which at least some of the pieces of roughness are constituted by ribs.

16. A packaged block of envelopes comprising:

a series of folded envelopes, each said folded envelope having a front face onto which a closure flap is folded over, a back face, and a periphery, the envelopes being disposed face against face, rigid retaining plates disposed on either side of said series of envelopes, said rigid retaining plates including a first plate facing a first one of the front and back faces of a first envelope in the series, and a second plate facing a second one of the front and back faces of a last envelope in the series, each of the rigid retaining plates having corners and a first face having a plane surface exempt from pieces of roughness against which said series of envelopes bears; and holding means for holding the series of envelopes together, said holding means surrounding the series of envelopes and the retaining plates tightly;

each of the envelopes has at least one thickness compensation shim having a thickness substantially equal to a thickness of the closure flap so that the envelope has a total thickness that is substantially identical in all of first, second, third, and fourth corners; and each of the retaining plates having a second face opposite from the first face and having perforations situated spaced apart from the corners of the retaining plate, so that the thickness compensation shims of the envelopes come into abutment against plane surface portions of the first faces of each said retaining plate.

17. A retaining plate for a block of envelopes to be packaged comprising a series of folded envelopes, each said folded envelope having a periphery, a back face, and a front face onto which a closure flap closes by being folded over along one edge, the envelopes being disposed face against face, the retaining plate being disposed with another retaining plate facing respective ones of a first envelope and a last envelopes in the series, said retaining plate having an inside face receiving the envelopes and an opposite outside face, peripheral edges defining a rectangular block; and perforations at least locally defined by one type of line selected from curved lines and from lines that slope relative to at least one of said peripheral edges of the retaining plate, wherein said perforations are passing through the retaining plate between the inside face and the opposite outside face.

18. A set comprising:

a plurality of packaged blocks of envelopes comprising:

a series of folded envelopes, each said folded envelope having a front face onto which a closure flap is folded over, a back face, and a periphery, the envelopes being disposed face against face, each face of each envelope having first, second, third, and fourth corners, and the closure flap of each said folded envelope having a thickness and being suitable for being folded over along an edge that interconnects the first and second corners;

rigid retaining plates disposed on either side of said series of envelopes, said rigid retaining plates including a first plate facing a first one of the front and back faces of a first envelope in the series, and a second plate facing a second one of the front and back faces of a last envelope in the series; and holding means for holding the series of envelopes together, said holding means surrounding the series of envelopes and the two retaining plates tightly; and a goods-handling pallet on which said packaged blocks of envelopes are disposed, the envelopes standing via edges of their peripheries on the goods-handling pallet, the blocks being disposed in a plurality of rows of stacks, adjacent rows of stacks of packaged blocks of envelopes being separated by a rigid vertical spacer extending perpendicular to those edges of the envelopes on which said envelopes stand.

19. A set according to claim 18, in which:

the rows of stacks of blocks of envelopes extend in the height direction over at least four superposed layers of blocks of envelopes in at least two adjacent rows of stacks; and the rigid spacer between two such rows of stacks extends over a height at least equal to the height of said four layers.

20. The retaining plate of claim 17, wherein:

the inside face against which the envelopes are disposed is plane and smooth, and said perforations comprise adjacent perforations between which ribs extend on the opposite outside surface.

* * * * *